United States Patent [19]

McNabb

[11] Patent Number: 4,597,437

[45] Date of Patent: Jul. 1, 1986

[54] PORTABLE PRODUCTION PACKAGE FOR OIL AND GAS WELLS

[76] Inventor: Stephen L. McNabb, Rte. 1, Millersburg, Ohio 44654

[21] Appl. No.: 600,540

[22] Filed: Apr. 16, 1984

[51] Int. Cl.[4] ..... E21B 43/00

[52] U.S. Cl. ..... 166/79; 166/75.1; 280/80 B

[58] Field of Search ..... 166/75 R, 79, 369, 379, 166/267, 356; 175/206; 137/267, 351, 344; 210/241; 280/80 B

[56] References Cited

U.S. PATENT DOCUMENTS

| | | | |
|---|---|---|---|
| 1,310,615 | 7/1919 | Greenlee | 166/267 |
| 1,476,747 | 12/1923 | Wolever | 175/206 |
| 1,962,463 | 6/1934 | Renfrew | 210/241 |
| 3,260,308 | 7/1966 | Cryer | 166/267 |
| 3,802,501 | 4/1974 | Mecusker | 166/75 R |
| 3,920,552 | 11/1975 | Elkern | 210/241 |
| 4,064,936 | 12/1977 | McClure | 166/75 R |
| 4,243,528 | 1/1981 | Hubbard et al. | 166/75 R |
| 4,273,347 | 6/1981 | Hulse | 280/80 B |
| 4,434,994 | 3/1984 | Pepin | 280/80 B |
| 4,493,382 | 1/1985 | Collins et al. | 175/207 |
| 4,522,258 | 6/1985 | DeWald | 166/57 |

OTHER PUBLICATIONS

"The Petroleum Engineer", Jan. 1944, p. 86.

*Primary Examiner*—James A. Leppink
*Assistant Examiner*—Hoang C. Dang
*Attorney, Agent, or Firm*—Reese Taylor

[57] ABSTRACT

A portable plumbing and production unit for use with a hydrocarbon producing well comprises a rigid structural frame, at least one oil storage tank mounted on said frame, a separator mounted on the frame, and at least one water storage tank mounted on the frame. Controls are also mounted on the frame and the controls, separator and oil and water storage tanks are interconnected with suitable plumbing and valving. The control and separator are also interconnected to the producing well and its pump so as to receive, separate, store, and dispense the hydrocarbons and the various constituents of the composition emitting from the well. This unit also includes a transportation unit detachably secured to the frame for support during transportation and for assistance in locating and positioning the package at the well site and a releasably mounted water knockout tank movable between transportation and operational modes.

17 Claims, 15 Drawing Figures

PORTABLE PRODUCTION PACKAGE FOR OIL AND GAS WELLS

BACKGROUND OF THE INVENTION

This invention relates, in general, to hydrocarbon producing wells capable of producing oil and gas and relates, in particular, to a portable, prefabricated production package for operating such a well under controlled conditions once the well has been properly drilled and prepared.

The installation and operation of hydrocarbon producing wells involve a number of well known steps. For purposes of describing the present invention, these preliminary steps will be discussed only briefly to establish the environment in which the present invention is employed.

Conventionally, suitable drilling apparatus is initially employed to drill a bore to the necessary depth to reach the hydrocarbon deposits. An outer metal casing is then installed in the bore to approximately one-half of the elevation above sea level of the depth of the hole to lock off the surface water and water table. It will, therefore, be appreciated that the depth of the casing can vary depending on circumstances and governmental requirements. In any event, once the casing is in place, a casing head or hanger is then secured on its top.

The outer casing is, of course, cemented in conventional fashion from the bottom up. Another, inner casing is next inserted and cemented in with a latch plug being employed to keep the cement from coming up the tube. The inner casing wall is then "fractured", which essentially involves the utilization of chemicals, hydrostatic, or hydraulic pressure to fracture the rock deposit so that a series of fissures or fractures will extend radially outwardly from the bore produced by the drill. Finally, the bottom of the casing is driven out in order to enable the well to receive the hydrocarbons. This is basically accomplished by perforating or shooting holes in the inner casing. This permits the hydrocarbons to flow into the central bore and eventually up through that bore between the inner and outer casings.

All of these steps are conventional and, at this point, the well is essentially ready for production with the next problem being to get the hydrocarbons out of the geological formation in which they are found, through the tubing, to enable them to be utilized or processed further as the case may be.

Depending upon the pressure in the well, there are primarily three different ways of accomplishing this. First, where the pressure is adequate, a free flow will occur and it is merely necessary to hook up the external plumbing. Second, where the pressure is not adequate for free flow, a plunger lift arrangement can be used. Third, if the pressure is not adequate to bring the hydrocarbons up naturally, a jack pump is employed. No detail will be entered into at this point on the structure or operation of these alternatives since these are expedients which are well known to those of ordinary skill in this art.

As noted, the well is now ready for production by one of the just mentioned methods. Typically, in many geological formations, however, the material coming out of the well is essentially a mixture of oil, gas, and salt water with lesser amounts of other chemicals and it is necessary to separate these elements before they can be employed, further processed commercially, or disposed of.

In order to accomplish this, once the well is in the condition just described, i.e., the site has been prepared, the hole has been drilled, the hole has been fractured, and the pumping mechanism is in place, it is then necessary to "plumb" the site.

This plumbing involves the installation of numerous tanks, tubing, lines, meters, valves, etc. The object of the plumbing is to provide means to separate the gas from the oil and then to separate the water from the gas and the oil as well as to store the elements thus separated. Current practice revels that there are a number of difficulties which are encountered in this plumbing operation.

First, the plumbing normally has to be done on the job site which involves advance planning and acquiring, assembling, and transporting all the necessary tools and apparatus to the site. One difficulty is that if anything is overlooked, the installers either resort to field expedients or lose time in returning to their base to complete the inventory. This is obviously costly in terms of labor and time.

Another related difficulty obviously is that these wells are outdoors and exposed to the environment, thereby making it necessary to perform all of the plumbing functions in what is often inclement weather. This often leads to hurried or careless installation.

Additionally, conventional on-site plumbing is costly because of the man hours involved. For a typical well, it usually takes about three actual working days by a three man crew to complete the plumbing. This, of course, assumes no interruptions because of weather.

The difficulty that is often encountered is that the roustabouts or other personnel sent to the well site to perform the plumbing operation are, at best, inexperienced and not necessarily highly skilled. Due to the difficult working conditions and lack of personnel skill, it is quite frequently the case that the well is simply not plumbed correctly. This creates significant safety problems because very significant pressures are involved with a typical well and if incorrect valves, for one example, are employed, serious danger is created for the personnel who have to operate and service the well over its subsequent operational life.

Another difficulty is that these wells will not be plumbed uniformally because they are being plumbed by different people at different times. Since, typically, one serviceman or one crew will service a plurality of operating wells, the lack of plumbing standardization makes maintenance difficult and it also makes it difficult to train people to service the wells once they are in full production.

Still another difficulty that is encountered is that all of these wells have a finite life. In other words, at some point the production will drop to the point where further production is uneconomical. Under the conventional system, the plumbing is more or less of a permanent nature and in order to move it from one well site to another, it is necessary to completely disassemble it. As a practical matter, the result is that a lot of the material such as tanks, tubing, etc., is rendered useless and this, of course, adds to cost of transferring the plumbing fixtures from one site to another.

Even if the materials are salvagable, a move is still also extremely costly. For example, it has been estimated that currently, with a typical well, an expense of something like $5,000.00 can be involved in a move of this type and, even then, the equipment is never reset the same way at the second well site and, therefore, additional or replacement plumbing materials are required. In other words, it is not possible to physically pick up the plumbing apparatus as a unit and move it to the subsequent site for reuse.

SUMMARY OF THE INVENTION

It has been found, therefore, and it is an object of this invention, to provide a completely portable, prefabricated production package suitable for use on a well site in order to effect the operation of the well.

In accordance with this object, it has been found that it is possible to completely assemble all of the plumbing, including the oil tanks, various lines, meters, gauges, and controls, in the factory, transport it to the well site, and install it with a very minimal amount of time and effort. It has also been found that a water knockout tank can be removably secured to such a package to facilitate servicing the well, particularly during its early operational life.

Utilization of such a production unit offers significant advantages over the prior art.

For one thing, the usual requirement for heavy equipment for unloading tanks, pipe threaders, etc., is eliminated.

Second, it is possible to assure, under rigidly controlled factory conditions, that the plumbing arrangement is precisely correct for the requirements of the well on which it is to be installed. No field expedients, no questionable substitutes of material, and really no decisions are required of the installer other than the basic decision as to where the unit is to be located with respect to the well. This results in a much safer unit. Additionally, with regard to safety, it is readily possible for appropriate government regulatory officials to inspect the plumbing arrangement in the factory prior to its installation in the field to insure that all specifications have been met.

Third, it has been found that by fabricating such a unit in a factory setting, it is possible to assemble a suitable plumbing package in about four hours. This contrasts to assembly in the field which takes, as noted above, something in the order of three days with a three man crew, even assuming no weather delays.

Fourth, in addition to the saving in time in the actual fabrication and assembly of the unit, it has been found through experience that one man can install a unit, once it has reached the job site, in about thirty minutes actual time, including about twelve minutes for unloading and about eighteen minutes for hooking up to the well and gas service line. All that is required is to drop the unit from its transport at the appropriate place and make two fitting connections. One of these connections, of course, is to the well itself to bring the hydrocarbons into the plumbing assembly and the other is with the sales line to the gas company. Other than that, all fittings, valves, joints, unions, etc., are fully, completely, and properly in place before the unit ever arrives at the well site.

Fifth, it has also been found that, when it is desired to move the package from one well site to another, it is simply necessary to undo the two fitting connections just referred to, remount the package on a suitable carrier, and move it.

Sixth, utilization of the removable water knockout tank makes it possible to accommodate the excess water content normally encountered in the early stages of production while permitting the tank to be easily removed for reuse elsewhere when no longer required.

The advantages just described are not intended to be exhaustive and others will readily come to mind. For one thing, for example, servicing the production unit becomes quite simple and can be accomplished with relatively inexperienced people. These people can be trained in the factory under ideal working conditions so that they are familiar with the plumbing arrangement. When they then encounter this arrangement in the field, it is a relatively simply matter for them to repair or maintain the installation. They will not be exposed to the problem of encountering a different plumbing set up on every well and the uniformity thus achieved is believed to result in significant cost savings and also, of course, to increase efficiency considerably.

Furthermore, the unit is so designed that if any component fails, it can be removed and replaced as a complete assembly. That is, since the specifications are known, a new sub-assembly can be factory-produced quite readily.

Accordingly, production of a portable, prefabricated production unit of the type just described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
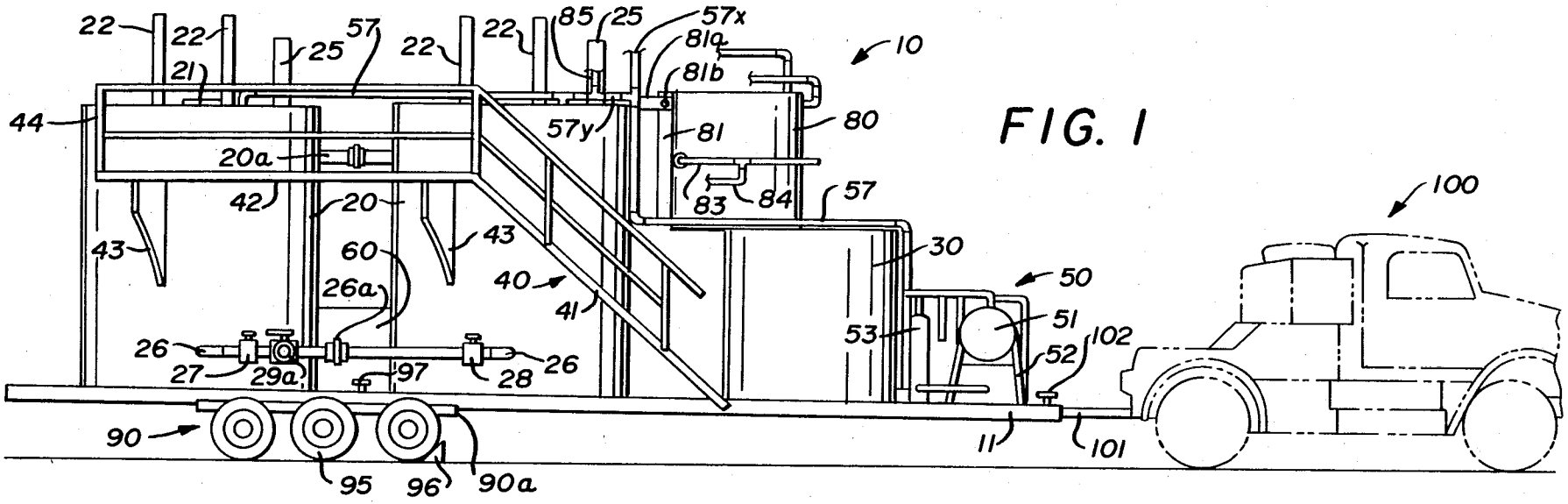
FIG. 1 is a side elevational view of the production package of this invention connected to a prime mover for transportation purposes and with the water knockout tank in its transportation mode.
Figure 10:
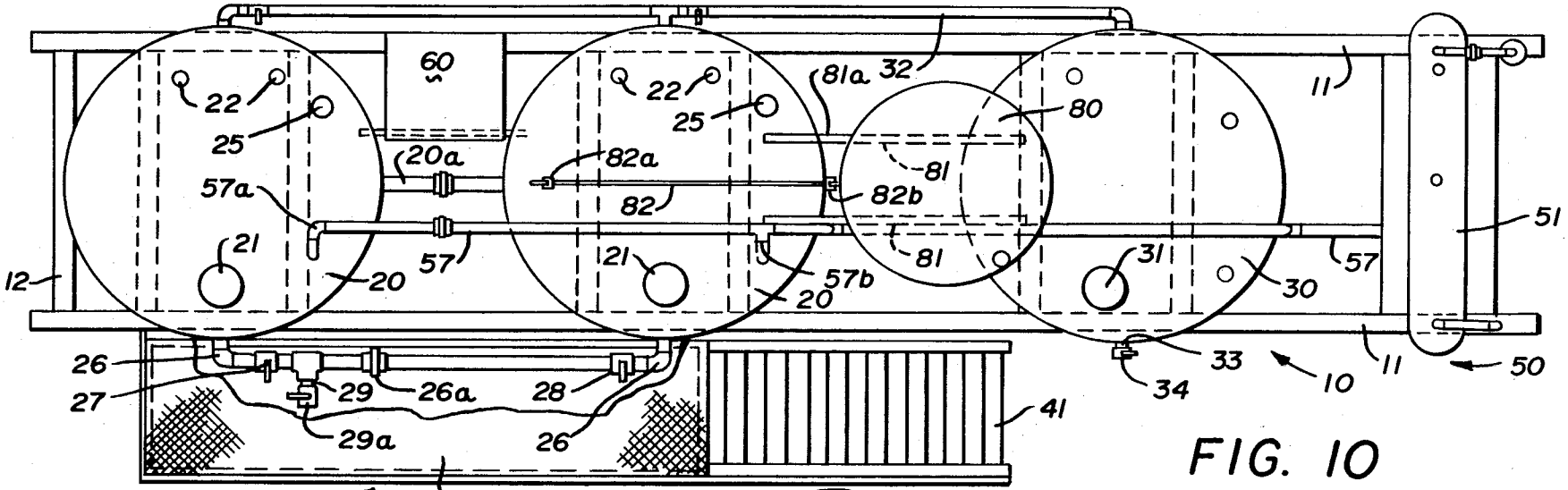
FIG. 10 is a top plan view of the production package of FIG. 5, partially broken away.

Referring first to FIGS. 1 and 10, it will be noted that the improved production package, generally indicated by the numeral 10, includes a number of main components.

The unit 10 is essentially mounted on a frame or skid which comprises structural, elongate I-beams 11,11 interconnected by structural cross braces 12,12 so as to form a generally rectangular, welded support frame or skid having considerable structural integrity itself.

Mounted on the frame or skid thus formed are one or more oil storage tanks 20 and a water storage tank 30, all of which are welded to the I-beams 11 and 12 to still further enhance the rigidity of the package. A ladder assembly 40 and a separator assembly 50 are also conventionally provided, as is a tool box 60. The rigidity of the basic package thus achieved is believed to be important because, in actual practice, a certain amount of settling can be anticipated. In conventional practice, where all the separate components are ground mounted, such settling risks disruption of the plumbing connections. With the system disclosed herein, such problems are eliminated.

It should also be noted at this point that there are a number of variables which will affect the precise combination of plumbing components required for a given well. In practice, Applicant has found that there are at least seventy-two different combinations which will fulfill the requirements of any well conditions normally encountered in practice.

For purposes of illustrating the invention here, only one of those combinations essentially involving two oil storage tanks, a water storage tank, and a horizontal separator are disclosed and will be described in detail. It will be understood, of course, that modifications can be resorted to without departing from the essence of the invention which is the concept of completely preassembling the production package at a remote site and then installing it at the well site by means of two simple connections. Thus, for example, the invention is not limited to any specific tank sizes or to any peculiar equipment requirements of any well conditions normally encountered.

Figure 5:
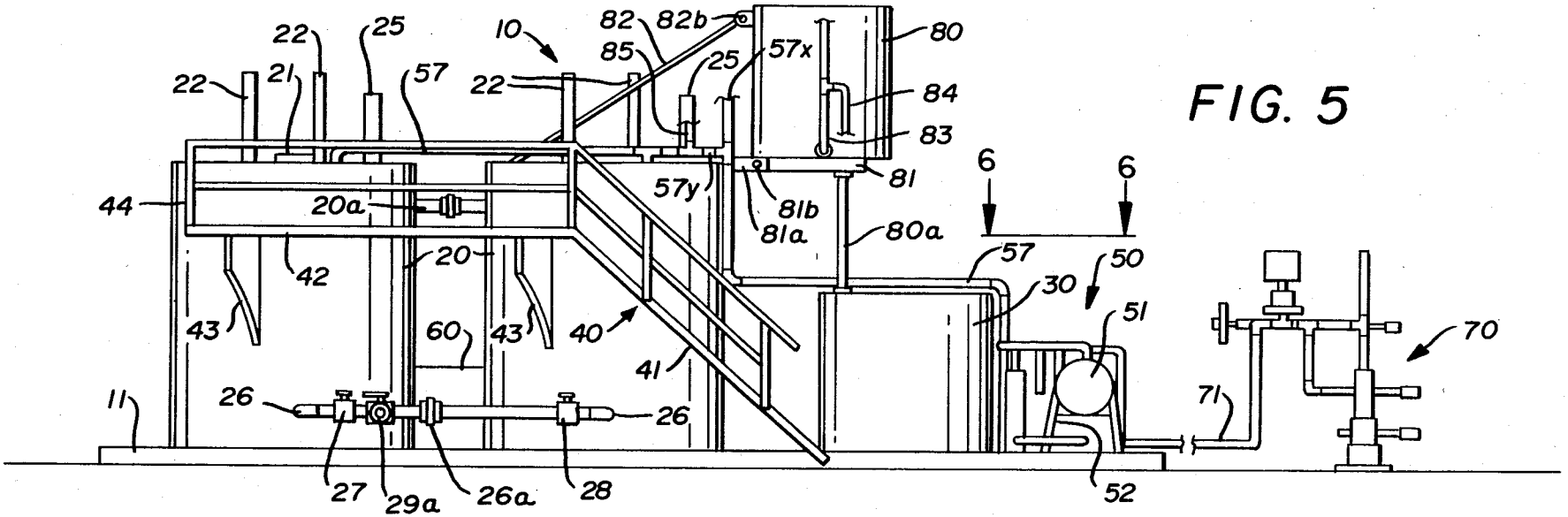
FIG. 5 is a side elevational view of the production package in place and connected to a working plunger lift system and with the water knockout tank in its operational mode.
Figure 6:
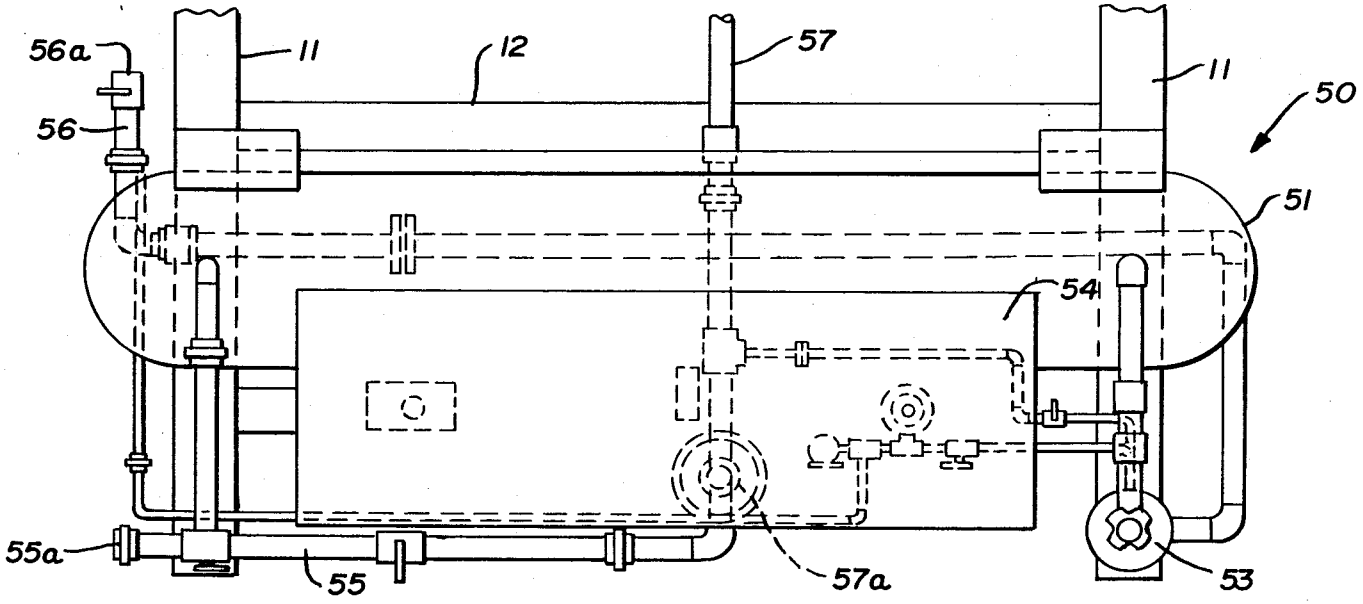
FIG. 6 is a top plan view of the separator assembly taken along the line 6—6 of FIG. 5.
Figure 7:
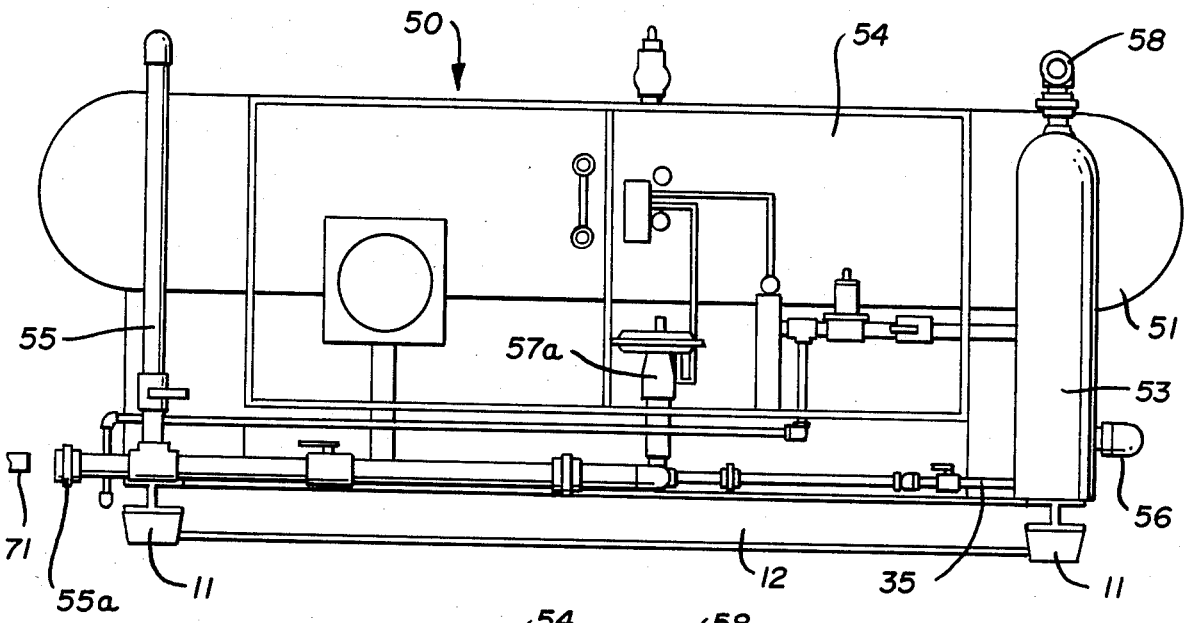
FIG. 7 is an end elevational view taken from the right of FIG. 5.

Continuing then with a description of the invention and referring again to FIGS. 1 and 10 of the drawings, it will be noted that the main frame, comprising the elongate structural I-beams 11,11 and cross beams 12,12, supports, in the form of the invention illustrated herein, a pair of oil storage tanks 20,20. These tanks are mounted onto the support members 11 and 12 and are welded thereto. The result, of course, is to elevate them from the ground when they are in place at the well site and also to enable them to be transported with the frame (see FIGS. 1 and 5).

Figure 11:
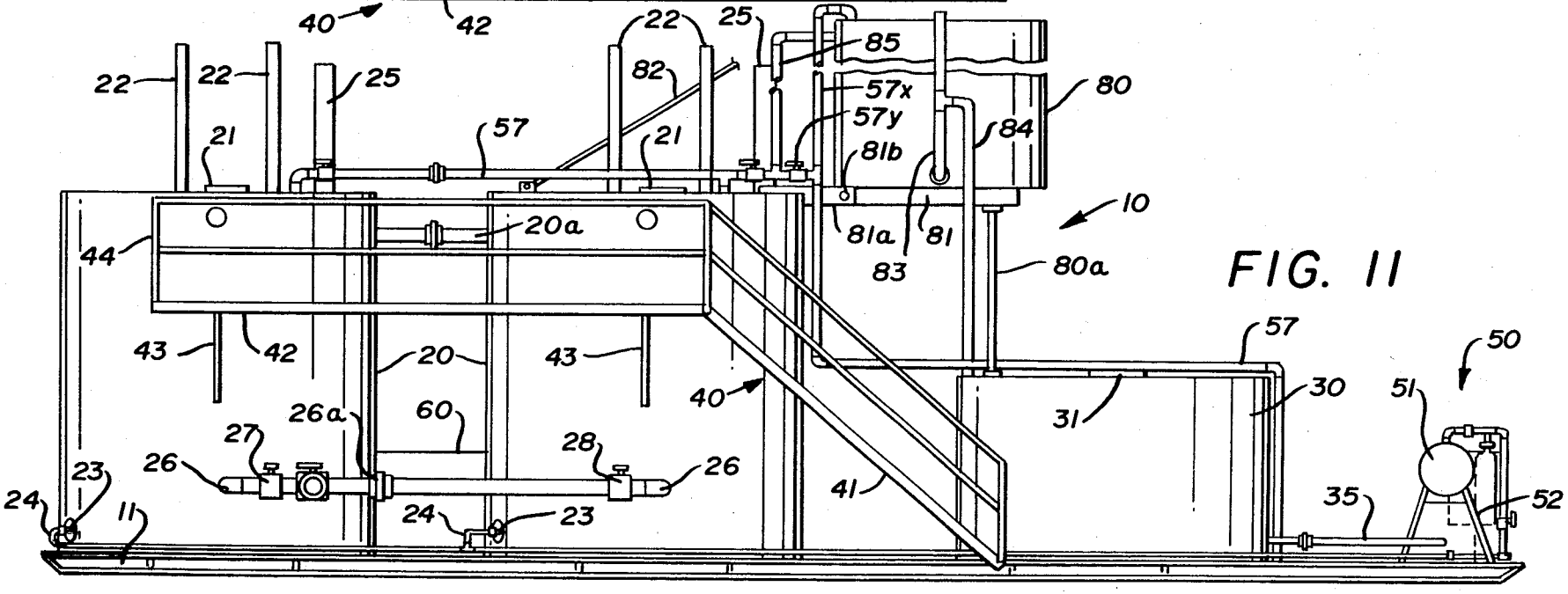
FIG. 11 is a side elevational view of the package of FIG. 10.

The oil storage tanks 20,20 include the usual access opening 21 at the top and the usual vent pipes 22 projecting from the top surface thereof. Furthermore, the normally employed heaters 24 are connected by the heater hoses 23,23 shown in FIG. 11 to the heat source and exhausted through heat stacks 25 with this structure being essentially conventional and being intended to permit the oil to be maintained in a relatively fluid condition during inclement weather. Such heating also improves the water-oil separation process by changing the oil viscosity.

The water storage tank 30 is also mounted on the frame members 11 and 12 and welded thereto and also has a conventional access opening 31 projecting from the top thereof. While not illustrated, where the water lacks sufficient salt content to prevent freezing under normal conditions, heating means similar to those used on the oil storage tanks can be employed.

Mounted on one side of the frame and welded to both the structural I-beam 11 and the oil tanks 20,20 is the ladder assembly 40. This includes a ladder 41 and a platform 42 with railings 44 which is, as can be seen, for example, in FIG. 1 of the drawings, supported on the side of the oil tanks 20,20 by braces 43. This permits ready access to the tanks for service and inspection purposes.

A tool box 60 is also illustrated (see FIG. 10) and is mounted on one of the structural I-beams 11 and, again, is welded securely thereto.

The separator and control assembly 50 is mounted on one end of the support frame. In the form of the invention illustrated herein, a horizontal, high pressure, separator unit is employed with it being understood, of course, that a vertical-type separator could alternatively be employed if desired.

Referring particularly to FIGS. 6 through 9, it will be seen that the separator and control assembly 50 generally includes the separator tank 51 mounted on the skid frame by means of the supports 52 at its opposed ends. A high pressure drip tank 53 is also employed and a suitable control unit 54 is mounted adjacent the separator tank. No detail will be entered into with regard to the control unit since the contents thereof are well within the skill of one knowledgeable in this art.

For operative purposes, however, it will be noted that a line 71 extends from the plunger lift system 70 of the well to the separator tank 51. A simple hammer union **55*a* is employed and, as will be described in greater detail below, upon setting of the production unit 10 at the well site, it is merely necessary to connect the line 71 from the plunger lift system 70 of the well to the intake line 55 through the union 55*a*. This permits the hydrocarbons to be removed from the well by plunger lift system 70** and passed into the plumbing system. Of course, as already noted, the plunger lift system illustrated is only one possible mechanism for extracting the hydrocarbons from the well.

A so-called "sales line" 56 is also connected to the separator 51 and control assembly 50 and is intended to transmit the gas removed from the hydrocarbon mixture to the line from the gas company (not shown). This is the second connection necessary to complete installation and is achieved, again, by use of a hammer union **56*a***.

As will be described again below, it should be noted at this point that those are the only two connections required at the well site.

A high pressure drip tank 53 is also employed and the hydrocarbons will enter the plumbing assembly through the line 55 and pass into the separator tank 51. At that point, the oil and gas will be separated with the gas moving into the drip tank 53 through line 58. The oil, of course being heavier, will settle to the bottom of the tank 51 and can be removed from the separator tank 51 through the line 57 through the dump valve **57*a* when it reaches a predetermined level in the separator tank and into the oil storage tanks 20,20 through the ball valves 57 and 57*b***. Obviously, suitable valving can be employed so as to direct the oil into the selected tank with it being possible to switch from tank to tank as the tanks fill up.

However, it ought to be noted at this point that a conventional overflow line or equalizer 20*a* is also provided and interconnects the tanks so that in the event the oil reaches a certain level in one tank, it will pass without the necessity of any valving to the other so as to avoid any problem with overflow.

In order to remove the oil stored in the tanks 20,20, oil discharge lines 26,26 are provided adjacent the bottoms of the tanks. These feed into butterfly valves 27 and 28 and a control valve 26*a* is also employed so that the oil can be removed from the tanks selectively as desired by the service personnel. The oil discharge line terminates in a pickup line 29 which has connected to it a butterfly valve 29*a* so that a tank truck can simply hook up to the valve 29*a*, open the valve, and remove the oil from the tanks.

Since the oil which passes into the oil storage tanks may still have some water in it and since the water and oil will eventually separate, it is desirable to be able to drain the water from the oil tanks. To that end, a water drain line 32 is connected to each oil tank and leads to the water storage tank 30. Of course, the water tank 30 will eventually fill up and excess water can be drained and removed through the water drain line 33 and the ball valve 34.

Where the well is producing an excessive amount of water, as is often the case during the early stages of production, a water knockout tank 80 can be employed between the separator tank 51 and the oil and water tanks 20 and 30. Thus, when the oil leaves the separator tank 51 under these circumstances, it can be diverted through line 57 to water knock out tank 80. Due to the fact that the oil is lighter than the water, a significant amount of separation will occur. The oil will then free flow into the oil storage tanks 20,20 and the water into the water storage tank 30, as will be described.

Referring to FIGS. 1 through 5, 11, and 15, it will be seen that the water knockout tank 80 has a pair of support braces 81,81 welded to its bottom surface. Brackets 81*a*,81*a* are welded to the lip of one of the oil storage tanks 20 and the braces 81,81 are pinned thereto by pins 81*b*,81*b* so that the tank 80 can be moved between its transportation position (see FIGS. 1 through 4) and its operational position (see FIGS. 5, 11, and 15). In its operational position, the tank 80 is held in position by cable 82, secured to the top of one of the tanks 20 by bracket 82*a* and to the tank 80 by bracket 82*b* (see FIGS. 5 and 11) and supported on the lip of tank 30 by legs 80*a*,80*a*. In its transportation position, the tank 80 can be pivoted downwardly about pins 81*b*,81*b* so as to reduce the overall height of the package during travel to and from the well site.

It is advantageous to provide a releasable mounting for the tank 80 by way of pins 81*b*,81*b* since the tank 80 often becomes superfluous after the well has been in operation for a while and the percent of water in the mixture drops whereupon it may be removed and used elsewhere.

Figure 15:
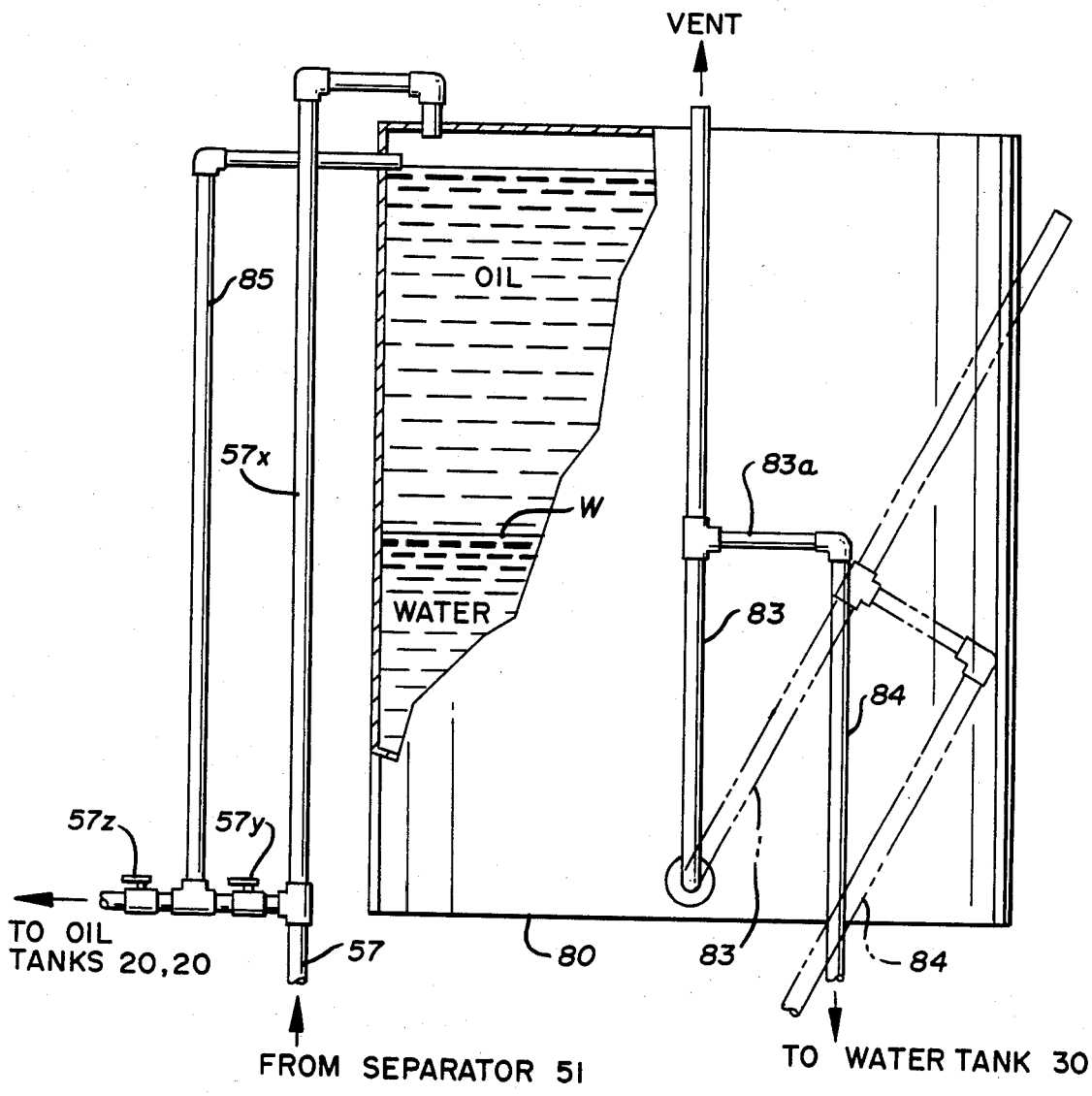
FIG. 15 is an elevational, partially broken away, view of the water knockout tank in its operational mode.

As can be seen from FIG. 15, the water knockout tank 80 is integrated into the packaged plumbing system by providing an extension 57*x* to line 57 and a valve 57*y* so that direct access to tanks 20,20 from the separator 51 can be cut off by valve 57*y* and the flow can be diverted to tank 80.

As can be appreciated, the water, being heavier than the oil, will settle to the bottom and can be diverted to the water storage tank 30 through pipe 83 and line 84. Pipe 83, which is mounted on the side of tank 80, is pivotable so that it can be swung out of the way during transportation and so that the water level in tank 80 can be controlled. As can be seen from FIG. 15, the location of cross line 83*a* will effectively control water level W.

The oil, having been separated from the water in tank 80, can then pass to the oil tanks 20,20 through line 85, valve 57*z*, and line 57.

As already noted, when the water knockout tank 80 is no longer needed it may be disconnected and removed for use elsewhere and the oil can flow directly into tanks 20,20 through line 57 and valve 57*y*.

Returning to the separator and control assembly 50 and assuming that the oil and gas have been separated, the gas is transmitted to the high pressure drip tank 53. This settles the water container therein and the water can pass from the drip tank 53 to either the water storage tank 30 or one of the oil storage tanks 20 for further separation through the line 35 (see FIG. 11).

The gas will be removed from the high pressure drip tank 53 through the sales or gas line 56 and into the gas company line (not shown).

Figure 12:
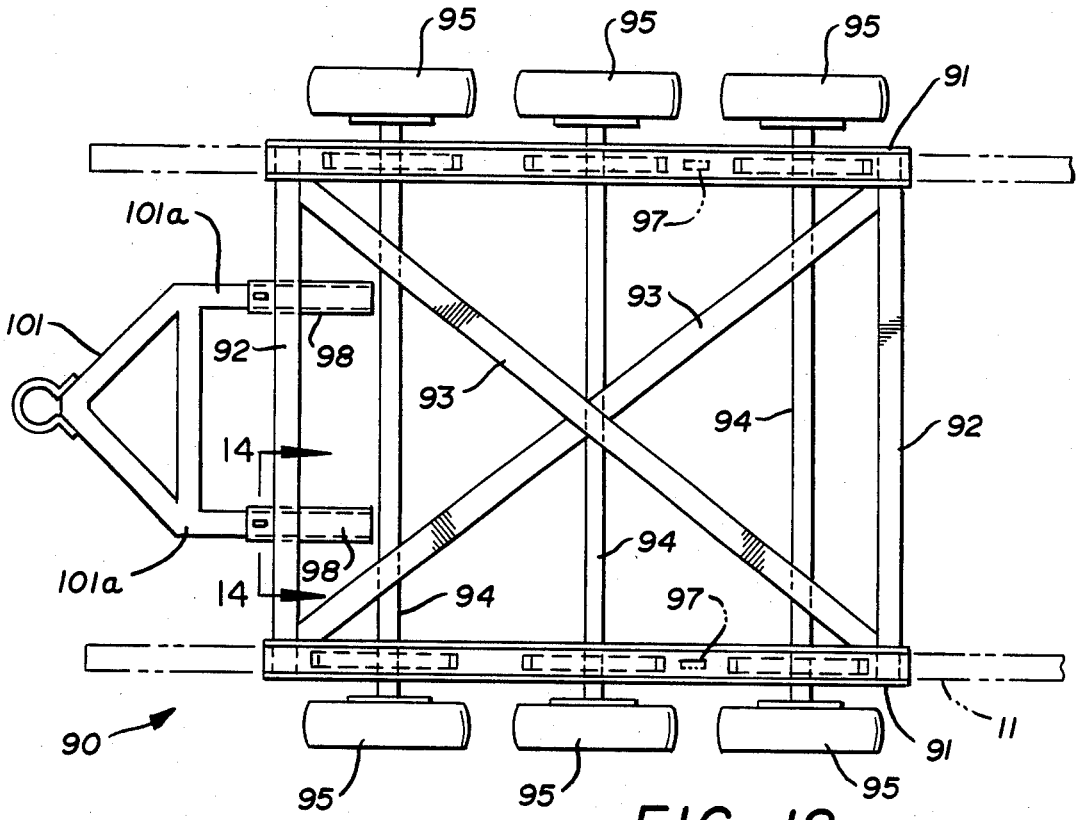
FIG. 12 is a top plan view of the dolly or transportation unit.
Figure 13:
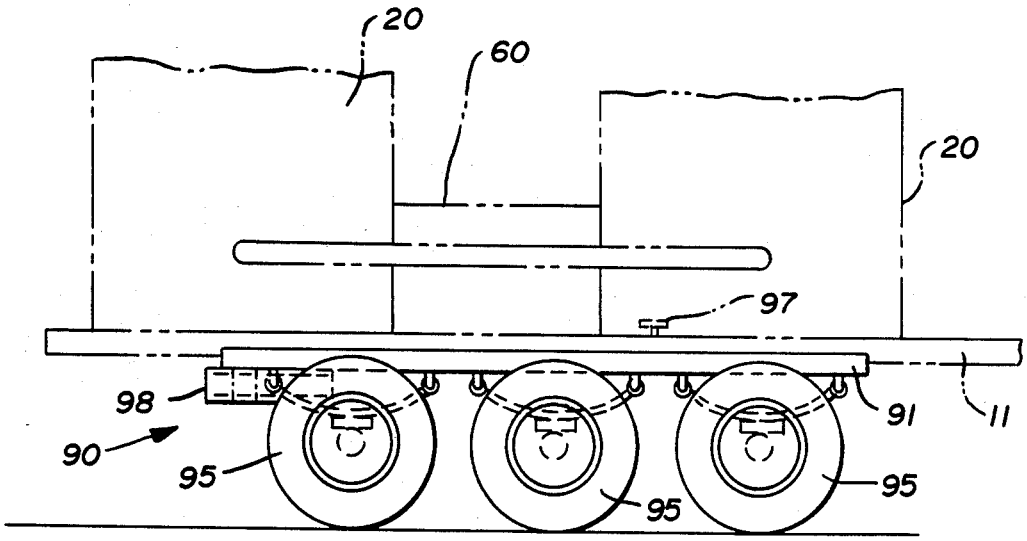
FIG. 13 is a side elevational view of the dolly of FIG. 12.
Figure 14:
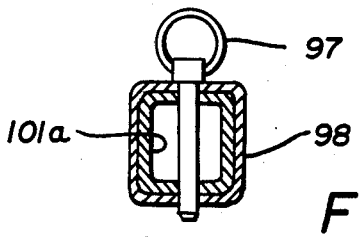
FIG. 14 is a sectional view taken along the line 14—14 of FIG. 12.

In order to transport the production unit from the factory to the well site, a dolly or transportation unit 90 (see FIGS. 12 and 13) is provided. This unit essentially has a rectangular frame comprising side frames 91,91, transverse frames 92,92, and, if desired, reinforcing cross frames 93,93.

Suitable axles 94,94 are provided and receive the wheels 95,95. The side frames 91,91 are constructed so that the structural I-beams 11,11 of the main frame can be slid inside of them and be secured thereto by suitable pins such as 97. This insures that when the dolly is moved, the frame will move with it. As illustrated, the end of the package bearing the oil storage tanks 20,20 is usually supported on the transportation unit 90 with the other end being releasably attached to a truck or other prime mover 100.

Figure 8:
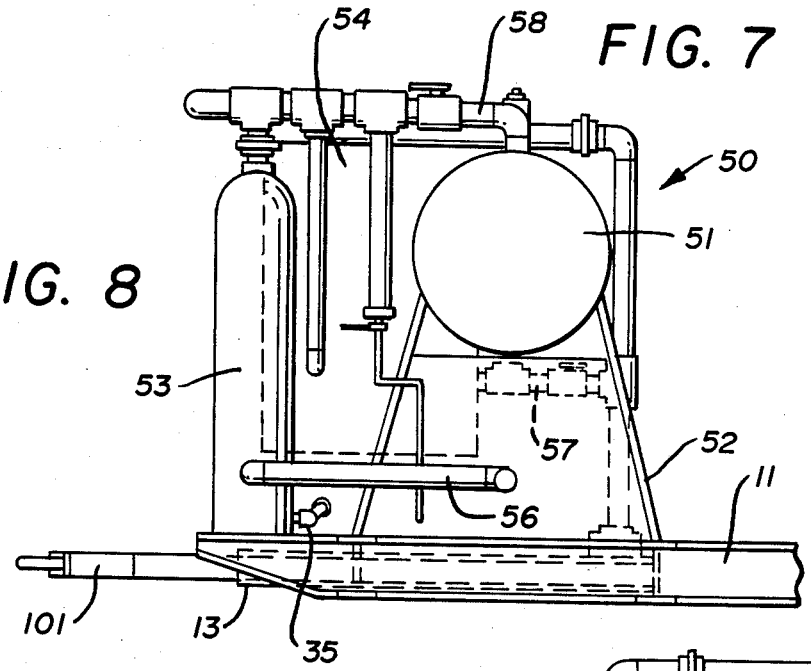
FIG. 8 is a side elevational view taken from the right of FIG. 7.
Figure 9:
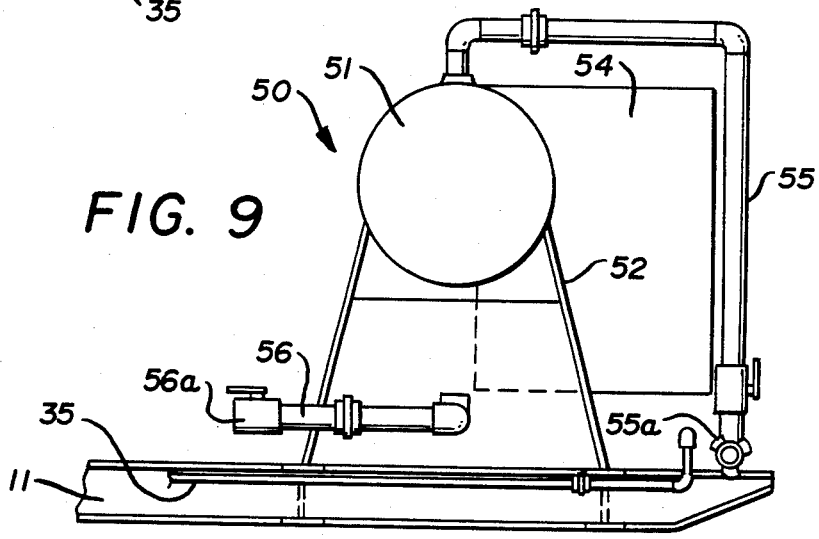
FIG. 9 is a side elevational view taken from the left of FIG. 7.

Referring to FIG. 1 of the drawings, for example, the prime mover 100 carries a conventional yoke 101. This yoke 101 is fit into channels 13,13 projecting from one of the cross frame members 12 of the skid and is pinned in place by pins 102 as also shown in FIG. 8. In that fashion, with the unit assembled to the condition of FIG. 1 of the drawings, the prime mover is capable of moving the unit from place to place.

Referring to FIGS. 1 through 4, once the unit has reached the desired location, the wheels 95,95 are locked or blocked in any desired way as by chock 96. It will be assumed that the package has been positioned at the desired location with respect to the plunger lift system 70 with it being noted that the position of forward end 90*a* (FIG. 1) of unit 90 will determine the location of the rear end of the package. This is about the only decision required on the well site.

Figure 2:
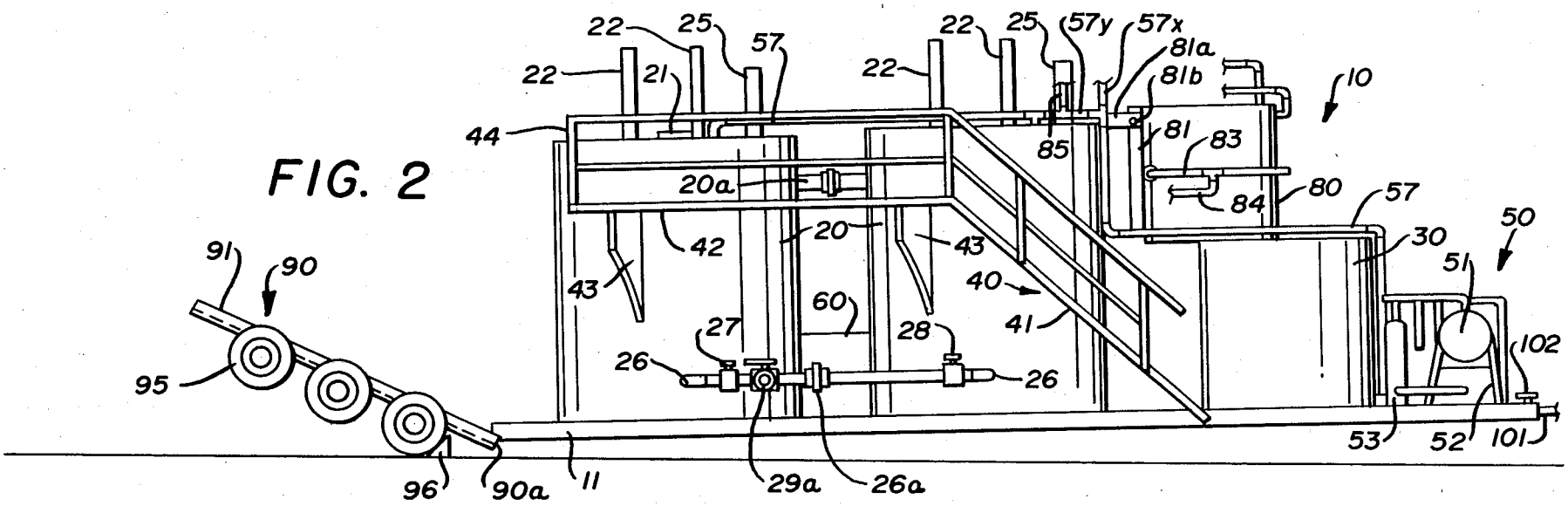
FIG. 2 is a side elevational view similar to FIG. 1 showing the unit being dropped in place at the well site.
Figure 3:
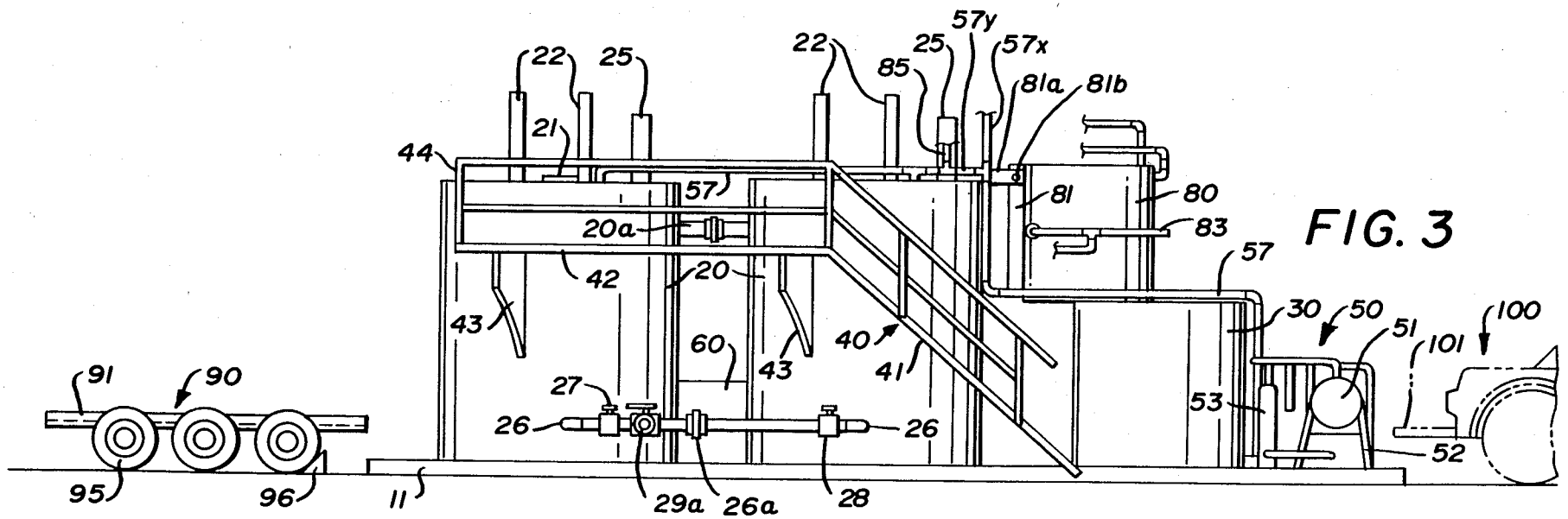
FIG. 3 is a side elevational view illustrating the production package in position, prior to hook-up, and with the prime mover disengaged.

Once the wheels have been locked or blocked, the pins 97,97 are removed to disconnect the unit 90 and the skid and the prime mover 100 pulls from right to left. Effectively, this pulls the main side channel members 11,11 of the frame out of the channels 91,91 of the dolly. As can be seen in FIG. 2, as the weight of the package is moved forward of the front wheel 95, the entire unit 90 tilts to form a ramp which permits the package to slide down onto the ground.

Placement is then completed by pulling pins 102 to disengage the yoke 101 from frame members 11,11.

Figure 4:
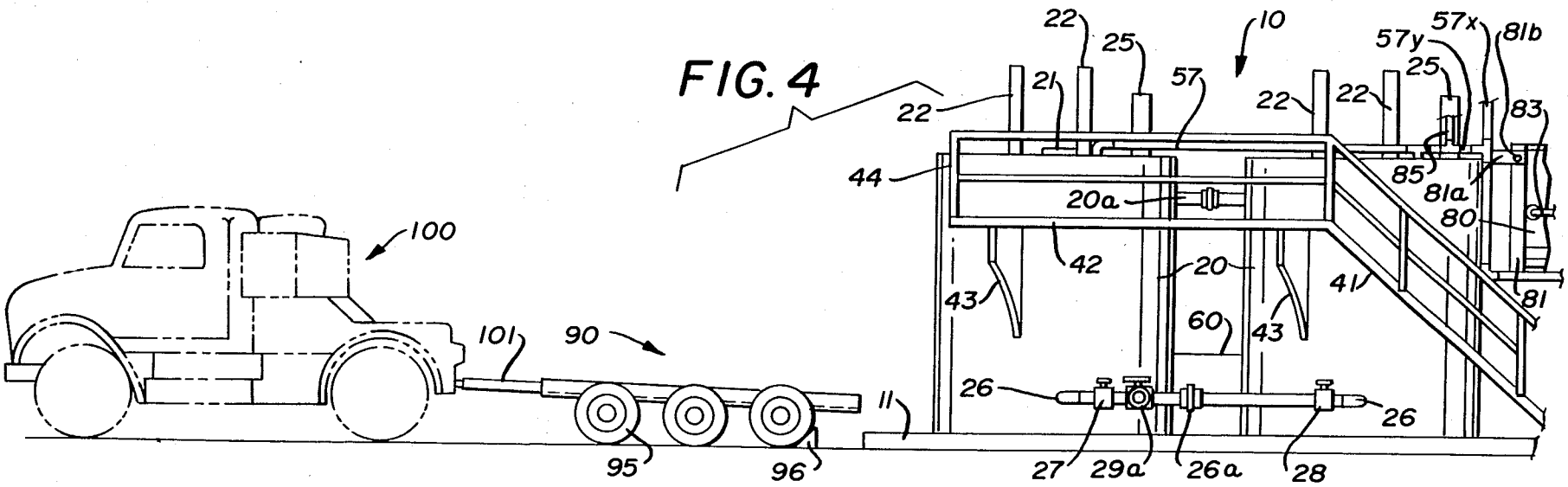
FIG. 4 is a partial side elevational view showing the production package in place and the prime mover reengaged with the transportation unit.

The prime mover may then be moved to a position adjacent the rear end of unit 90 (see FIG. 4). One of cross frame members 92 of unit 90 has channels 98,98 which receive the legs 101*a*,101*a* of yoke 101 which can be secured thereto by pins 97 or 102 so that prime mover 100 can remove transportation member 90.

At this point, the production package is ready for connection to the well. This is simply accomplished by connection of intake line 55 to the line 71 from plunger lift system 70 by hammer union 55*a* and connection of sales line 56 to the gas line by hammer union 56*a*. Once the valves have been opened, the well is in production.

The enormous savings in on-the-site time can readily be appreciated.

It will thus be seen how a complete production package can be completely assembled to proper specifications in a controlled, factory environment, readily transported to the well site, and quickly and easily installed.

While a full and complete description of the invention has been set forth in accordance with the dictates of the Patent Statutes, it should be understood that modifications can be resorted to without departing from the spirit hereof or the scope of the appended claims.

Thus, as previously mentioned, only one typical combination of components, i.e., two oil storage tanks, one water storage tank, a horizontal separator, and a water knockout tank with suitable plumbing, has been illustrated and described herein. Many various combinations of components are possible depending upon the characteristics of the individual well. Which components are required can be ascertained after the well has been logged and can then be assembled into the unique package.

What is claimed is:

1. A portable, self contained production package for use with a hydrocarbon producing well and a gas removal line to perform all necessary initial on site processing, comprising:

(A) a rigid frame including a parallelogram of at least two opposite elongate beam members and a plurality of transverse structural members of lesser length than said elongate beam members secured between said beam members;

(B) at least one oil storage tank secured to the top of said at least two beam members of said frame and at least one of said transverse structural members;

(C) separator means mounted on said frame;

(D) control and metering means mounted on said frame (E) plumbing means interconnecting the well, said control means, said oil storage tank and said separator means;

(F) first connection means included in said plumbing means and disposed between said separator means and the well for releasable attachment to said well; and (G) second connection means included in said plumbing means and disposed adjacent said separator means for releasable connection with the gas removal line.

2. The package of claim 1 wherein at least one water storage tank is secured to said beam members of said frame and at least one of said transverse structural members thereof; said plumbing means also interconnecting said water storage tank to said separator means.

3. The package of claim 2 wherein said elongate beam members and said transverse structural members are welded together; a pair of oil storage tanks and said water storage tank are welded to said structural members and an over flow line is secured between said oil storage tanks adjacent their tops.

4. The package of claim 2 wherein a water knockout tank is releasably secured to said oil storage tank for movement between transportation and operational positions.

5. The package of claim 4 wherein connecting means movable between transportation and operational positions are provided for operationally connecting said water knockout tank with said water storage tank, said oil storage tank, and said well.

6. The package of claim 1 wherein access means are mounted on said frame adjacent said oil storage tank and are secured to one of said elongate beam members and said tank.

7. The package of claim 4 wherein said access means include a ladder and platform mounted on and projecting from said frame and said oil storage tank.

8. The package of claim 6 further characterized by the presence of transportation means releasably connected to said rigid frame adjacent opposed ends thereof.

9. The package of claim 4 wherein said transportation means include means for locating said package adjacent said well; said last mentioned means including a support frame slidably engaging said rigid frame.

10. The package of claim 4 wherein said transportation means include a prime mover releasably attached to one end of said rigid frame and a transportation unit releasably secured to the opposed end of said frame; said prime mover being attachable to said transportation unit upon release thereof from said rigid frame.

11. The package of claim 10 wherein said transportation unit includes a wheeled dolly releasably pinned to and slidably engaging said rigid frame; said dolly including a support frame with longitudinally projecting channels; said prime mover carrying a yoke engagable with said channels.

12. A portable, self contained production package for use with a hydrocarbon producing well and an associated gas removal line, comprising:

(A) a rigid frame including (1) parallely disposed elongate structural members and (2) transverse structural members of lesser length than said elongate structural members welded to and interconnecting said elongate structural members;

(B) at least one oil storage tank welded to at least two of said elongate structural members and spanning the distance therebetween;

(C) separator means mounted on said frame; and (D) plumbing means interconnecting the well, said separator means and said oil storage tank;

(E) first connection means included in said plumbing means and disposed between said separator means and the well for releasable attachment to said well; and (F) second connection means included in said plumbing means and disposed adjacent said separator means for releasable connection with the gas removal line.

13. The package of claim 12 wherein at least one water storage tank is welded to at least said elongate structural members between said oil storage tank and said separator means; said plumbing means interconnecting said separator means, said water storage tank and said oil storage tank.

14. The package of claim 13 wherein a water knockout tank is releasably secured to the top of said oil storage tank for movement between transportation and operational positions; said plumbing means interconnecting said water knockout tank, the well, said separator means, and said oil and water storage tanks.

15. The package of claims 12 or 13 wherein transportation means are releasably secured to opposed ends of said rigid frame.

16. The package of claim 15 wherein said transportation means include a prime mover releasably attached to one end of said frame; a wheeled transportation unit releasably attached to and supporting the opposed end of said rigid frame; and a yoke attached to said prime mover and selectively engagable with said rigid frame and said wheeled transportation unit.

17. The package of claim 14 wherein said water knockout tank is pivotally secured to said oil storage tank; the portion of said plumbing means interconnecting said water knockout tank and said oil and water storage tanks being movable between transportation and operational positions.

* * * * *